US005299353A

United States Patent [19]

Nazmy et al.

[11] Patent Number: 5,299,353

[45] Date of Patent: * Apr. 5, 1994

[54] TURBINE BLADE AND PROCESS FOR PRODUCING THIS TURBINE BLADE

[75] Inventors: Mohamed Nazmy, Fislisbach; Markus Staubli, Dottikon, both of Switzerland

[73] Assignee: Asea Brown Boveri Ltd., Baden, Switzerland

[ * ] Notice: The portion of the term of this patent subsequent to Mar. 2, 2010 has been disclaimed.

[21] Appl. No.: 880,036

[22] Filed: May 8, 1992

[30] Foreign Application Priority Data

May 13, 1991 [EP] European Pat. Off. ..... 91107707.1

[51] Int. Cl.[5] ..... B23P 15/00

[52] U.S. Cl. ..... 29/889.7; 29/889.1; 416/241 R

[58] Field of Search ..... 415/200; 416/241 R; 29/889.1, 889.7, 527.6; 148/670, 671; 420/418

[56] References Cited

U.S. PATENT DOCUMENTS

| | | | |
|---|---|---|---|
| 3,997,640 | 12/1976 | Walton, Jr. | 29/889.7 |
| 4,631,092 | 12/1986 | Ruckle et al. | 148/421 |
| 4,746,374 | 5/1988 | Froes et al. . | |
| 4,820,360 | 4/1989 | Eylon et al. . | |
| 4,849,168 | 7/1989 | Nishyama et al. | 420/418 |
| 5,028,491 | 7/1991 | Huang et al. | 420/418 |
| 5,076,858 | 12/1991 | Huang | 148/11.5 F |
| 5,082,506 | 1/1992 | Huang | 148/421 |
| 5,125,811 | 6/1992 | Amano et al. | 29/889.7 |
| 5,190,603 | 3/1993 | Nazmy et al. | 420/418 |

FOREIGN PATENT DOCUMENTS

| | | | |
|---|---|---|---|
| 2136170 | 12/1972 | France . | |
| 58-57005 | 4/1983 | Japan . | |
| 3171862 | 7/1988 | Japan . | |
| 1-202389 | 8/1989 | Japan | 29/889.7 |
| 696715 | 9/1953 | United Kingdom . | |

OTHER PUBLICATIONS

"Intermetallische Phasen, Werkstoffe zwischen Metall und Keramik", G. Sauthoff, pp. 15–19.

*Primary Examiner*—Irene Cuda

*Attorney, Agent, or Firm*—Burns, Doane, Swecker & Mathis

[57] ABSTRACT

The turbine blade contains a casting having a blade leaf (1), blade foot (2) and, if appropriate, blade cover strip (3) and composed of an alloy based on a dopant-containing gamma-titanium aluminide.

This turbine blade is to be distinguished by a long lifetime, when used in a turbine operated at medium and high temperatures, and, at the same time, be capable of being produced in a simple way suitable for mass production. This is achieved in that, at least in parts of the blade leaf (1), the alloy is in the form of a material of coarse-grained structure and with a texture resulting in high tensile and creep strength and, at least in parts of the blade foot (2) and/or of the blade cover strip (3), provided if appropriate, is in the form of a material of fine-grained structure and with a ductility increased in relation to the material contained in the blade leaf (1).

14 Claims, 1 Drawing Sheet

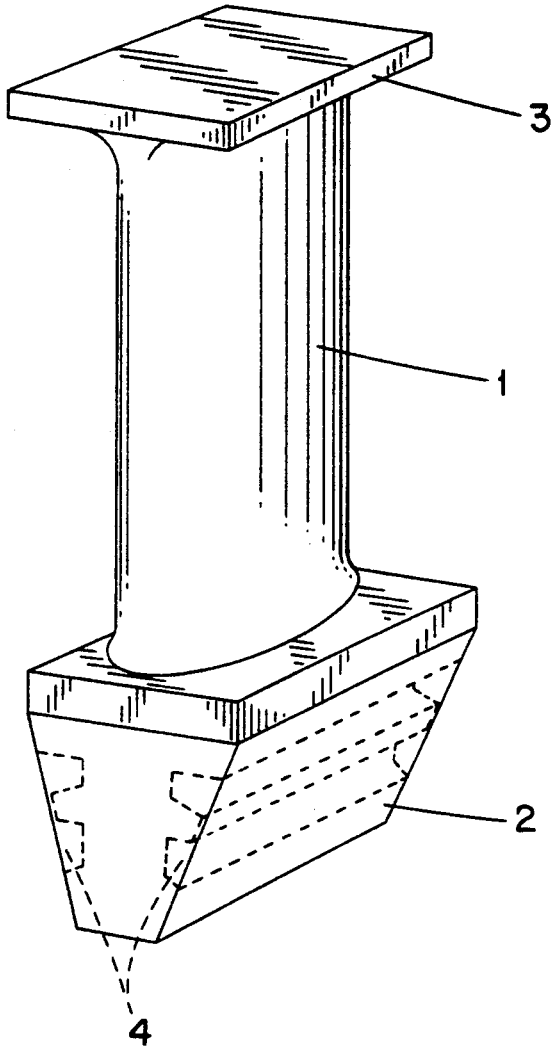
3
1
2
4

TURBINE BLADE AND PROCESS FOR PRODUCING THIS TURBINE BLADE

BACKGROUND OF THE INVENTION

1. Filed of the Invention

The invention starts from a turbine blade containing a casting having a blade leaf, blade foot and, if appropriate, blade cover strip and composed of an alloy based on a dopant-containing gamma-titanium aluminide. The invention starts, furthermore, from a process for producing such a turbine blade.

2. Discussion of Background

Gamma-titanium aluminides have properties which are beneficial to their use as a material for turbine blades exposed to high temperatures. These include, among other things, their density, which is low in comparison with superalloys conventionally used, for example where Ni-superalloys are concerned the density is more than twice as high.

A turbine blade of the type mentioned in the introduction is known from G. Sauthoff, "Intermetallische Phasen", Werkstoffe zwischen Metall und Keramik, Magazin neue Werkstoffe ["Intermetallic phases", materials between metal and ceramic, the magazine new materials]1/89, pages 15–19. The material of this turbine blade has a comparatively high heat resistance, but the ductility of this material at room temperature is comparatively low, and therefore damage to parts of the turbine blade subjected to bending stress cannot be prevented with certainty.

SUMMARY OF THE INVENTION

The invention, as defined in patent claims 1 and 4, is based on the object of providing a turbine blade of the type mentioned in the introduction, which is distinguished by a long lifetime, when used in a turbine operated at medium and high temperatures, and, at the same time, of finding a way which makes it possible to produce such a turbine blade in a simple way suitable for mass production.

The turbine blade according to the invention is defined, in relation to comparable turbine blades according to the state of the art, by a long lifetime, even under a high stress resulting especially from bending. This becomes possible in that the parts of the turbine blade subjected to differing stress have differently specified modifications of the gamma-titanium aluminide used as the material. At the same time, it proves especially advantageous in terms of production if the turbine blade is simply shaped from a one-piece casting which is inexpensive to make. Furthermore, this process can be designed in a simple way for mass production by the use of commonly available means, such as casting molds, furnaces, presses and mechanical and electrochemical machining devices.

Preferred exemplary embodiments of the invention and the advantages affordable thereby are explained in more detail below by means of a drawing.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein: the single FIGURE shows an annealed, hot-isostatically pressed, hot-formed and heat-treated casting, from which the turbine blade according to the invention is produced by material-removing machining.

DESCRIPTION OF THE PREFERRED EMBODIMENT

Referring now to the drawing, the annealed, hot-isostatically pressed, hot-formed and heat-treated cast illustrated in the FIGURE has the essential material and form properties of the turbine blade according to the invention. It contains an elongate blade leaf 1, a blade foot 2 formed on one end of the blade leaf 1, and a blade cover strip 3 formed on the opposite end of the blade leaf. The turbine blade according to the invention is produced from this casting by means of slight material-removing machining. The material-removing machining essentially involves an adaptation of the dimensions of the casting to the desired dimensions of the turbine blade. Where the blade foot 2 and the blade cover strip 3 are concerned, this is advantageously carried out by grinding and polishing. At the same time, the fastening slots 4 of the blade foot 2, which are represented by broken lines in the FIGURE and which have a pine-tree arrangement can also be formed by this process. The blade leaf is preferably adapted to the desired blade-leaf form by electrochemical machining.

The casting illustrated in the FIGURE consists essentially of an alloy based on a dopant-containing gamma-titanium aluminide. At least in parts of the blade leaf 1, this alloy is in the form of a material of coarse-grained structure and with a texture resulting in high tensile and creep strength. At least in parts of the blade foot 2 and of the blade cover strip 3, the alloy is in the form of a material of fine-grained structure and with a ductility increased in relation to the material contained in the blade leaf 1. This ensures a long lifetime for the blade leaf. On the one hand, this is because the blade leaf, being at high temperatures during the operation of the turbine, has a good tensile and creep strength as a result of its coarse-grain structure and its texture whereas its low ductility, occurring at low temperatures, is of no importance. On the other hand, it is also because, during the operation of the turbine, the blade foot and the blade cover strip are at comparatively low temperatures and then, as a result of their fine-grained structure and their texture, have a high ductility in comparison with the material provided in the blade leaf. Comparatively high torsional and bending forces can thereby be absorbed over a long period of time by the blade foot and by the blade cover strip, without stress cracks being produced.

The turbine blade according to the invention can advantageously be employed at medium and high temperatures, that is to say at temperatures of between 200° and 1000° C., especially in gas turbines and in compressors. Depending on the embodiment of the gas turbine or compressor, the blade cover strip 3 can be present or be omitted.

The casting according to the FIGURE is produced as follows: under inert gas, such as, for example, argon, or under a vacuum, the following alloy based on a gamma-titanium aluminide, with chrome as a dopant, is melted in an induction furnace:

Al = 48 Atomic %
Cr = 3 Atomic %
Ti = remainder.

Other suitable alloys are gamma-titanium aluminides in which at least one or more of the elements B, Co, Cr, Ge, Hf, Mn, Mo, Nb, Pd, Si, Ta, V, Y, W and Zr are contained as dopant. The quantity of dopant added is preferably 0.5 to 8 atomic percent.

The melt is poured off in a casting mold corresponding to the turbine blade to be produced. The casting formed can thereupon advantageously, for the purpose of its homogenization, be annealed at approximately 1100° C., for example for 10 hours, in an argon atmosphere and cooled to room temperature. The casting skin and scale layer are then removed, for example by stripping off a surface layer of a thickness of approximately 1 mm mechanically or chemically. The descaled casting is pushed into a suitable capsule made of soft carbon steel and the latter is welded to it in a gastight manner. The encapsulated casting is now pressed hot-isostatically under a pressure of 120 MPa at a temperature of 1260° C. for 3 hours and cooled.

Depending on the composition, the annealing of the alloy should be carried out at temperatures of between 1000° and 1100° C. for at least half an hour and for at most thirty hours. The same applies accordingly to the hot-isostatic pressing which should advantageously be carried out at temperatures of between 1200° and 1300° C. and under a pressure of between 100 and 150 MPa for at least one hour and for at most five hours.

Thereafter, a once-only to repeated isothermal hot forming of the part of the annealed and hot-isostatically pressed casting corresponding to the blade foot 2 and/or to the blade cover strip 3 is carried out to form the material of fine-grained structure, and a heat treatment at least of the part of the annealed and hot-isostatically pressed casting corresponding to the blade leaf 1 is carried out before or after the isothermal hot forming to form the material of coarse-grained structure.

Two methods can advantageously be adopted for this. In the first method, the annealed and hot-isostatically pressed casting is heat-treated before the isothermal hot forming to form the material of coarse-grained structure, whereas in the second method the part of the annealed and hot-isostatically pressed casting comprising the blade leaf is heattreated after the isothermal hot forming to form the material of coarse-grained structure. It has proved expedient, before the isothermal hot forming, to heat the annealed and hot-isostatically pressed casting at a speed of between 10° and 50° C./min to the temperature required for the hot forming.

In the first method, the casting is heated to temperature of 1200° to 1400° C. and, depending on the heating temperature and alloy composition, is heat-treated for between 0.5 and 25 hours. During the cooling, a heat treatment lasting a further 1 to 5 hours can be carried out. After the heat treatment, the casting has a coarse-grained structure and a texture resulting in too high a tensile and creep strength. The heat-treated casting is heated to 1100° C. and maintained at this temperature. The blade foot 2 and/or the blade cover strip 3 are then forged isothermally at 1100° C. The tool used is preferably a forging press consisting, for example, of a molybdenum alloy of the trade name TZM having the following composition:

Ti =0.5 % by weight
Zr =0.1 % by weight
C =0.02 % by weight
Mo =remainder.

The yield point of the material to be forged is approximately 260 MPa at 1100° C. The forming is obtained by upsetting to a deformation $\epsilon=1.3$, in which:

$$\epsilon = 1n \frac{h_o}{h}, \text{ where}$$

$h_o$ =original height of the workpiece and
h =height of the workpiece after forming.

The linear deformation rate (ram speed of the forging press) is 0.1 mm/s at the start of the forging process. The initial pressure of the forging press is at approximately 300 MPa.

As a function of the alloy composition, the hot forming can be carried out at temperatures of between 1050° and 1200° C. with a deformation rate of between $5 \cdot 10^{-5}s^{-1}$ and $10^{-2}s^{-1}$, up to a deformation $\epsilon=1.6$. Advantageously, at the same time, the parts to be hot-formed, such as the blade foot 2 and, if appropriate, also the blade cover strip 3, can first be kneaded in the forging press by upsetting in at least two directions transverse to the longitudinal axis of the turbine blade and then be finish-pressed to the final form. The finish-pressed parts have a fine-grained structure with a ductility increased in relation to the material contained in the blade leaf. In the turbine blade produced as described above, the tensile strength and ductility of the material are, in the blade leaf 1, at 390 MPa and 0.3 % respectively and, in the blade foot 2 and in the blade cover strip 3, at 370 MPa and 1.3 % respectively.

In the second method, the casting is heated to 1100° C., for example at a heating speed of 10° to 50° C./min, and is maintained at this temperature. The blade foot 2 and/or the blade cover strip 3 are then forged isothermally at 1100° C. according to the process previously described. The finish-forged parts likewise have a fine-grained structure with a ductility increased in relation to the material contained in the blade leaf 1.

By means of an induction coil attached round the blade leaf 1, the blade leaf is then heated to a temperature 1200° to 1400° C. and, depending on the heating temperature and alloy composition, is heattreated for between 0.5 and 25 hours. During cooling, heat treatment lasting a further 1 to 5 hours can be carried out. After the heat treatment, the blade leaf has predominantly a coarse-grained structure and a texture resulting in a high tensile and creep strength. In a turbine blade produced in this way, the tensile strength and ductility of the material in the blade leaf 1 or in the blade foot 2 and in the blade cover strip 3 have virtually the same values as in the turbine blade produced by the previously described process.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters patent of the United States is:

1. A process for producing a cast turbine blade having a blade leaf, blade foot and optionally a blade cover strip and composed of an alloy based on a dopant-containing γ-titanium aluminide, the alloy in the blade leaf having a coarse-grained structure which provides high tensile and creep strength and the alloy in the blade foot and/or the blade cover strip having a fine-grained structure which provides increased ductility in relation to the material contained in the blade leaf, the process comprising steps of:

melting the alloy;

pouring the melt and forming a casting in the form of the turbine blade;

hot-isostatic pressing the casting;

isothermal hot forming part of the hotisostatically pressed casting corresponding to the blade foot and/or the blade cover strip to form the fine-grained structure;

performing a heat treatment of part of the hot-isostatically pressed casting corresponding to the blade leaf before or after the isothermal hot forming to form the coarse-grained structure; and machining the hot-isostatically pressed, hot-formed and heat-treated casting to form the turbine blade.

2. The process as claimed in claim 1, wherein the hot-isostatically pressed casting is heat-treated before the isothermal hot forming to form the coarse-grained structure.

3. The process as claimed in claim 1, wherein the part of the hot-isostatically pressed casting comprising the blade leaf is heat-treated after the isothermal hot forming to form the coarse-grained structure.

4. The process as claimed in claim 3, wherein the heat treatment is carried out by means of an induction coil.

5. The process as claimed in claim 1, wherein the heat treatment is carried out at between 1200° and 1400° C.

6. The process as claimed in claim 5, wherein a further heat treatment at between 800° and 1000° C. is subsequently carried out.

7. The process as claimed in claim 1, wherein the hot forming is carried out at between 1050° and 1200° C. with a deformation rate of between $5 \cdot 10^{-5}s^{-1}$ and $10^{-2}s^{-1}$, up to a deformation $\epsilon = 1.6$, in which $$\epsilon = 1n \frac{h_o}{h}$$

$h_o$ = original height of the workpiece and h = height of the workpiece after forming.

8. The process as claimed in claim 7, wherein the hot forming is carried out in a forging press.

9. The process as claimed in claim 8, wherein the parts to be hot-formed are first plastically deformed in the forging press by upsetting in at least two directions transverse to the longitudinal axis of the turbine blade and are then finish-pressed to the final form.

10. The process as claimed in claim 1, wherein, before the isothermal hot forming, the hot-isostatically pressed casting is cooled to room temperature and is subsequently heated at a speed of between 10° and 50° C./min to the temperature set during the hot forming.

11. The process as claimed in claim 1, wherein the casting is homogenized at temperatures of between 1000° and 1100° C. before the hot forming and the heat treatment.

12. The process as claimed in claim 1, wherein the hot-isostatic pressing is carried out at temperatures of between 1200° and 1300° C. and under a pressure of between 100 and 150 MPa.

13. The process as claimed in claim 1, wherein at least one or more of the elements B, Co, Cr, Ge, Hf, Mn, Mo, Nb, Pd, Si, Ta, V, Y, W and Zr are contained as dopant in the alloy.

14. The process as claimed in claim 13, wherein the alloy has at least 0.5 and at most 8 atomic % of the dopant.

* * * * *